United States Patent [19]

Malmberg

[11] 4,103,413

[45] Aug. 1, 1978

[54] METHOD AND ARRANGEMENT FOR FASTENING AND CENTERING PUNCHING TOOLS

[76] Inventor: Sven Kurt Bernhard Malmberg, Bokvagen 3, S-265 00 Åstorp, Sweden

[21] Appl. No.: 795,913

[22] Filed: May 11, 1977

[30] Foreign Application Priority Data

May 11, 1976 [SE] Sweden ..... 7605336

[51] Int. Cl.[2] ..... B26F 1/02

[52] U.S. Cl. ..... 29/465; 33/181 R; 83/13; 83/139; 83/698; 83/701

[58] Field of Search ..... 83/13, 701, 698, 699, 83/13, 139, 141, 635; 29/465; 33/181 R

[56] References Cited

U.S. PATENT DOCUMENTS

| | | | |
|---|---|---|---|
| 2,089,795 | 8/1937 | Hodge | 29/465 |
| 2,504,642 | 4/1950 | Burgess | 33/181 X |
| 3,064,511 | 11/1962 | Allander | 83/13 |
| 3,848,452 | 11/1974 | Gargrave | 83/700 X |

*Primary Examiner*—J. M. Meister

*Attorney, Agent, or Firm*—Lerner, David, Littenberg & Samuel

[57] ABSTRACT

A method and arrangement is provided for fastening and centering a tool comprising a die element and a punch element, in a press. A centering setup socket is axially displaceable on one tool element and has close fit on the other tool element. The setup socket remaining on said one tool element is retractable from the other tool element by the relative movement of the tool elements.

7 Claims, 8 Drawing Figures

METHOD AND ARRANGEMENT FOR FASTENING AND CENTERING PUNCHING TOOLS

The invention relates to a method in fastening and centering tools, comprising a die element and a punch element, in presses having press members, movable in relation to each other, wherein one tool element is positioned on one press member in a predetermined place, while the other tool element is centered or afterwards is being centered in relation to the tool element thus positioned.

It is not possible to center the two tool elements in relation to each other by lowering the punch into the die for the simple reason that the punch must have a relatively large clearance in the die, the size of the clearance being dependent of the thickness of the metal plate that shall be worked in the tool, which means that the fit of the tool elements is never sufficiently accurate for centering the tool elements in relation to each other. Therefore, it has been proposed earlier to perform the centering by means of a special setup socket, and this method is described in e.g. U.S. Pat. No. 2,504,642 issued Apr. 18, 1950. According to this patent specification, either tool element is first positioned in the predetermined place thereof and then the other tool element is centered in relation to the one already positioned, by means of a setup socket, which is temporarily used and which is removed from the tool when the centering and fastening of said other tool element has been finished, in order to leave room for a stripper which is then mounted onto the punch element. The method according to this patent specification provides that either tool element can be removed from the holder thereof after having been centered and fastened in order to allow removal of the setup socket, and then can be replaced again in the position accurately determined by previous operations without altering the centration of the tool elements, when the stripper before that has been mounted onto the punch element. Therefore, it is necessary in this prior art method to have a holder for at least one tool element which can be fastened in a predetermined position of the associated press shoe and also has means for removably connecting the tool element to the holder, which means that the tool structure will be complicated, as will be seen from the patent specification, and that the centering method will be cumbersome and time-consuming.

Considerably more elegant is the method described in U.S. Pat. No. 3,064,511 according to which the centering of the tool elements is achieved by using a stripper on the punch element and an ejector on the die element as mutually engaging setup elements, the tool elements being fastened to the respective press shoes by using a double-adhesive plastic foil. The method is based on the knowledge that between the ejector and the stripper there can be arranged an accurate fit independently of the clearance which is required between the punch and the die, but the presence of an ejector and associated springs in the die excludes the possibility to arrange a passage in the die for removing the punching scrap material. This has turned out to be a considerable drawback. The fact is that the scrap material must be knocked from the punched openings when the punching has been made, which means that tools for punching washers and other mass products from metal plate straps cannot be set up in series arrangement due to the fact that the scrap material from one punching station will be pressed down into and will be carried along by the metal plate to a succeeding puching station causing tool breakdowns due to the fact that the punched products then loosen from the metal plate strap and collect in said succeeding punching station. If the scrap material is not knocked away completely or adheres to a greasy metal plate and is carried along to other working operations (or machines) such as edge folding, this will result in double plate thickness where the scrap material appears providing a high surface pressure and tool breakdown. Triangular or segmented cuttings in metal plate edges cannot be made rationally due to the fact that the scrap material will not be carried along by the metal plate but will stick in the cavity of the stripper on top of the punch. Moreover, a heavy noise will be produced when the scrap material is knocked away, which is a drawback from an environment point of view. Furthermore, when the method according to U.S. Pat. No. 3,064,511 is carried into effect, the tools must be constructed with a stationary die, which means that a revision of the tool, if necessary, will hardly be worth while. If several tools are set up in a press, grinding of a tool may cause e.g. a wrong height of the die in relation to adjacent tools which results in bending of the metal plate.

For openings others than round considerable production costs and precision problems will arise when the method according to U.S. Pat. No. 3,064,511 is applied because the tools must have not only the specially formed punch, die and stripper but also have an ejector which matches the form and size of the die and the punch at the respective ends thereof in order to bridge the necessary clearance between the punch and the die. Since the clearance between ejector, stripper and die must be practically zero, the ejector and the stripper, moreover, will easily be damaged at a minor displacement of either tool part from the centered position.

It is a primary object of this invention to provide new and improved method and arrangement for fastening and centering punching tools.

It is a further object of this invention to provide new and improved method and arrangement of the art referred to, whereby an accurate centering of the tool elements is achieved without intervening dismounting and mounting operations.

A still further object of this invention is to provide a method and arrangement of the art referred to, wherein the die element can be constructed with a scrap passage for removal of punching scrap material in the conventional way.

Yet another object of this invention is to provide new method and arrangement of the art referred to, allowing punch and die to be easily replaced and adjusted.

Additional objects and advantages of the invention will be set forth in part of the description which follows and in part will be obvious from the description, or may be learned by practice of the invention. The objects and advantages of the invention may be realized and attained by means of the instrumentalities and combinations particularly pointed out in the appended claims.

To achieve the foregoing objects and in accordance with the purpose of the invention, as embodied and broadly described herein, there is provided a method according to this invention for fastening and centering a tool in presses having press members movable in relation to each other, said tool comprising die and punch elements, said punch element having a punch and a stripper, wherein one tool element is positioned on one press member in a predetermined place, the other tool element is centered in relation to the tool element thus positioned by means of a setup socket on either tool element, and said setup socket is mounted with close fit on the opposite tool element, the improvement wherein the setup socket is mounted on the associated tool element guided for axial movement thereon in order to surround the punch and the stripper and with such fit in relation to the two tool elements that the socket remaining on the associated tool element is retractable from the opposite tool element by the relative movement of the tool, and wherein the tool elements are fastened in a centered position in relation to each other, the setup socket being displaced axially on the associated tool element and being allowed to remain in the position thus occupied during the use of the punching tool.

According to the invention there is also provided an arrangement in a tool for fastening and centering the tool in a press having press members movable in relation to each other, said tool comprising die and punch elements, each with a holder, the punch element having a punch and a stripper, comprising a setup socket on one of the tool elements, mounted with slide fit on the holder of said one tool element and guided for axial movement on said holder in a position wherein it surrounds the punch and the stripper, and further comprising a portion on the holder of the other tool element, having a close fit in the socket.

Preferably the axial displacement of the setup socket is performed by moving the punch into the die.

It is also preferred that the holder of said one tool element forms an outer cylindrical surface for guiding and supporting the setup socket.

It is also preferred that the cylindrical surface is formed at least partially by a collar arranged on the holder, said collar surrounding the punch and the stripper over part of the axial length thereof.

It is also preferred that the setup socket is resilient circumferentially and has destorted cylindrical form to engage the tool elements along at least three generatrices.

Finally, it is also preferred that the two tool elements are guided for axial displacement by pins in slots in the setup socket.

The accompanying drawings, which are incorporated in and constitute a part of this specification, illustrate embodiments of the invention and, together with the description, serve to explain the principles of the invention.

Reference will now be made in detail to the present preferred embodiments of the invention, examples of which are illustrated in the accompanying drawings.

Figure 1:
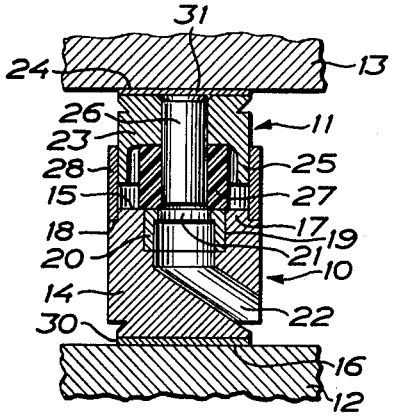
FIG. 1 is a vertical sectional view of a tool mounted between shoes, which illustrates the initial phase of the centering operation according to the invention.
Figure 2:
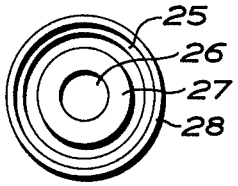
FIG. 2 is a plan view from below of the punch element, viz. the upper tool element in FIG. 1.

The punching tool according to FIG. 1 comprises a die element 10 and a punch element 11 which are mounted in a manner to be described on a lower press shoe 12 and an upper press shoe 13, respectively, said latter press shoe being plane-parallel with the lower press shoe. Said press shoes may be included in a pillar stand which is arranged in an excenter press. The die element comprises a cylindrical die holder 14 having a plane upper end surface 15 and a plane lower end surface 16, and this die holder forms at the top a studlike portion 17 of less diameter than the main portion of the holder and joins the rest of the die holder at an annular shoulder 18. In the die holder there is a cylindrical cavity 19 open in end surface 15, for the reception of a die 20 arranged as a bushing in said cavity and having a circular die opening 21 arranged therein, and a scrap passage 22 connects to cavity 19 and thus to die opening 21, said passage opening at the side of the die holder.

The punch element 11 comprises a cylindrical punch holder 23 having a plane upper end surface 24 and a downwardly directed circumferential collar 25. In the punch holder there is mounted a cylindrical punch 26 projecting beyond the end of collar 25, and on this punch there is mounted with press fit a stripper 27 of elastic material, which is formed as a cylindrical bushing an extends somewhat beyond the end of punch 26. This stripper can be made of e.g. a hard-elastic plastic material such as polyurethane.

Figure 3:
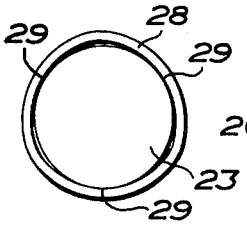
FIG. 3 is a diagrammatic view showing exaggeratedly the engagement of the setup socket with the punch element along three equally spaced generatrices.

Now, on punch holder 23 there is mounted with slide fit a sleeve or socket 28. This socket can be completely cylindrical, but this raises great demands as to the tolerances between the socket, the punch holder and the die holder. It is more suitable that socket 28 is deformed in the manner shown in FIG. 3 so that it engages the die holder along three generatrices at positions designated 29 in FIG. 3. Socket 28 should have such close fit on the punch holder 23 that it does not move up and down in relation to the punch holder due to inertia at the normal reciprocating movement of the punch, but on the other side it must not have such a tight fit on the punch holder that it cannot be displaced manually. This socket 28 forms a setup socket for centering the punch and the die in relation to each other so that the punch 26 moves centrically down into the die opening 21, a uniform space being provided between the edges of the punch and the die opening of a size which is dependent, according to known technique, of the thickness of the metal plate to be worked in the punch tool. For this purpose setup socket 28 has a light slide fit on the studlike portion 17 of die holder 14.

When the punch tool described is being disposed between the two press shoes 12 and 13 and the two tool elements 10 and 11 are being connected one to each of these press shoes the following method is applied.

When punch element 11 is disposed on top of die element 10 as shown in FIG. 1, centered in relation to the die element by means of setup socket 28, the complete punching tool is positioned on press shoe 12 possibly together with other punching tools in order to provide a certain pattern of openings in the metal plate to be punched, the position of said punching tool(s) on press shoe 12 being determined by means of a template or the like according to known technique. Alternatively, the die element(s) may first be positioned at the intended places and then the punch elements may be mounted on their respective die elements, said punch elements being centered by means of the setup socket. Die holder 14 is not, however, positioned directly on press shoe 12; between the plane end surface 16 and press shoe 12 there is provided a double-adhesive plastic foil 30. When the punching tool(s) is(are) being positioned the upper press shoe 13 is moved to its upper end position such that there is a space between the press shoe and the upper end surface 24 of punch holder 23. Also on this surface there is provided a double-adhesive plastic foil 31. The punching tool now stands as a unit on press shoe 12, the two tool elements being accurately centered in relation to each other by means of setup socket 28 which surrounds collar 25, stripper 27 and punch 26 and is threaded on the studlike portion 17 of die holder 14 and rests at the lower annular end surface thereof on shoulder 18.

Figure 4:
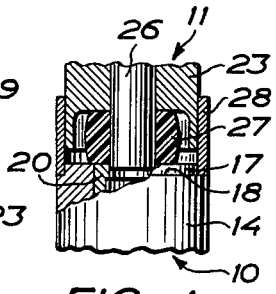
FIG. 4 is a fragmentary view similar to FIG. 1 of a second phase of the centering operation.
Figure 5:
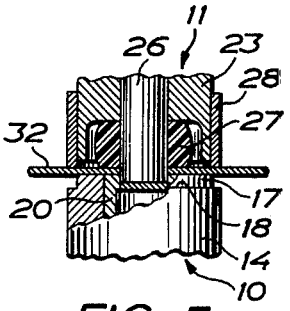
FIG. 5 is a fragmentary view similar to FIG. 1 illustrating the first punching stroke.
Figure 6:
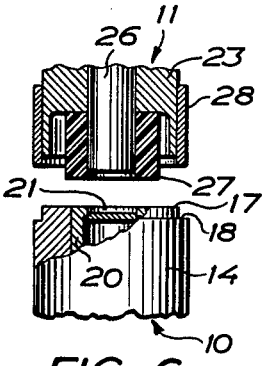
FIG. 6 is a fragmentary view similar to FIG. 1 with the tool elements mutually spaced after the first punching stroke.

Next step in the mounting of the punching tool on press shoes 12 and 13 is that the upper press shoe 13 is lowered towards the punching tool to engagement with the double-adhesive plastic foil 31, i.e. to the position according to FIG. 1, and at continued downward movement of press shoe 13 the punching tool now reaches the position according to FIG. 4. In this position the punch 26 is introduced into the die opening 21 of die 20 and the hard-elastic stripper 27 is squeezed between the upper plane end surface 15 of the die holder 14 and the punch holder 23 inwardly of the surronding collar 25. Setup socket 28 has been displaced a short distance upwards on punch holder 23 during the downward movement of punch 26 into die 20. By means of the double-adhesive plastic foils 30 and 31, respectively, the die element 10 and the punch element 11, respectively, have been fastened to the associated press shoes 12 and 13, respectively, so that punch element 11 will be carried along by press shoe 13 when this returns to its upper end position. The punch tool is now ready for use, and a metal plate 32, FIG. 5, can be introduced between the two tool elements, setup socket 28 engaging metal plate 32 at the next stroke of press shoe 13 and thus of punch element 11, as shown in FIG. 5, so that the setup socket will be displaced a further distance upwards on punch holder 23. Consequently, after this first punching operation the setup socket 28 will have the position on punch holder 23 which is disclosed in FIG. 6. When the setup socket has fulfilled the function thereof to center the two tool elements 11 and 12 in relation to each other, it is allowed to remain on the tool in this position where it will in no way interfere with the punching operations. The centering is obtained without using any ejector in the die element 10 which is instead provided with scrap passage 22 which allows a rapid removal of punching scrap material without intervening knocking out operations and, as mentioned initially, enables series punching to be performed in the punching tool according to the invention. Since a replaceable die 20 can be used, the position of the die can easily be adjusted by means of shims possibly after a grinding operation having been performed. The punch as well as the die are easily replaceable which means that there is the possibility not only to perform an adjustment, if any, but also to use punches and dies for different metal plate gauges in one and the same tool.

Figure 7:
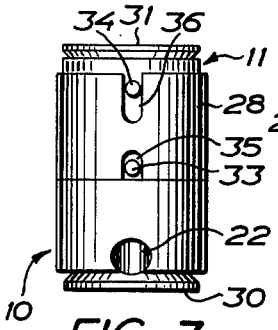
FIG. 7 is a side view of a tool having a non-circular punch and die illustrating guide means for the setup socket.
Figure 8:
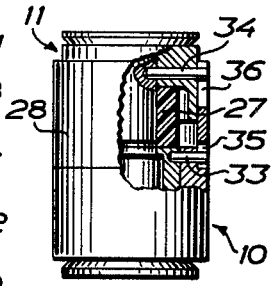
FIG. 8 is a side view, partly a vertical sectional view, of the means in FIG. 7 perpendicularly to the view shown therein.

In the embodiment described there was used double-adhesive plastic foil 30 and 31 for fastening the tool elements to their associated press shoes but it is also conceivable to fasten the tool elements by means of magnetic members or by means of screw elements. Whatever the connection is, there is provided, by using setup socket 28, an excellent centering in a simple manner, tolerance deviations, if any, being overcome by making the setup socket non-circular, e.g. in the manner illustrated in FIG. 3, In case punch and die have not circular form, some kind of guide must be provided in order to guarantee that the punch element and the die element will have the correct rotational position in relation to each other when being mounted. This guide can be arranged e.g. as shown in FIGS. 7 and 8 where die 20 is kept in a predetermined rotational position in relation to die holder 14 by means of a pin 33 projecting from the studlike portion 17 of the die holder above shoulder 18, and punch 26 is held in relation to punch holder 23 by means of a corresponding pin 34 projecting from the outer curved surface of punch holder 23. These two radially arranged pins are received by axial slots 35 and 36, respectively, in setup socket 28 whereby it is guaranteed that the two tool elements are in a correct rotational position in relation to each other when they are being centered by means of setup socket 28. For the rest the centering of the tool elements is performed in exactly the same manner as earlier described.

In the embodiments described setup socket 28 is provided on punch element 11 but it can as well be provided on die element 10, the setup socket being pushed downwards on the die element by means of a shoulder on the punch element corresponding to shoulder 18, when the tool elements are moved together, and the final position of the setup socket on the die element being determined by metal plate 32 when this is pressed against the plane upper end surface 15 of die element 14 in the first punching operation. Other types of strippers than a stripper which is made of a hard-elastic plastic material can, of course, be used but the hard-elastic plastic material is preferred because the noise level when the tool is being used is reduced thereby. However, it is essential that the stripper can be mounted on the punch element 11 before, during or after centering the tool elements in relation to each other because it is located inwardly of setup socket 28, and thus it is not necessary to resort to intervening dismounting and mounting operations before the punching tool can be used after the centering having been made.

It will be apparent to those skilled in the art that various other modifications and variations in addition to those mentioned above could be made in the method and arrangement of the invention without departing from the scope and spirit of the invention.

I claim:

1. An arrangement in a tool for fastening and centering the tool in a press having press members movable in relation to each other, said tool comprising die and punch elements each with a holder, the punch element having a punch and a stripper, comprising a setup socket on one of the tool elements, mounted with slide fit on the holder of said one tool element and guided for axial movement on said holder in a position wherein it surrounds the punch and the stripper, and further comprising a portion on the holder of the other tool element, having a close fit in the socket.

2. An arrangement as claimed in claim 1 wherein the holder of said one tool element forms an outer cylindrical surface for guiding and supporting the setup socket.

3. An arrangement as claimed in claim 2 wherein the cylindrical surface is formed at least partially by a collar arranged on the holder, said collar surrounding the punch and the stripper over part of the axial length thereof.

4. An arrangement as claimed in claim 1 wherein the setup socket is resilient circumferentially and has destorted cylindrical form to engage the tool elements along at least three generatrices.

5. An arrangement as claimed in claim 1 wherein the two tool elements are guided for axial displacement by pins in slots in the setup socket.

6. A punching tool setup method for fastening and centering a tool in presses having press members movable in relation to each other, said tool including die and punch elements, said punch element having a punch and a stripper, comprising the steps of positioning one tool element on one press member in a predetermined place, placing a setup socket on either tool element, centering said tool elements in relation to each other by means of said setup socket, fastening said tool elements in said centered position in relation to each other, mounting said setup socket for axial movement on said tool elements and to surround said punch and said stripper, said setup socket remaining in position on said tool elements during operation of said punch element.

7. A method in accordance with claim 6 further including the step of moving the punch into the die in order to axially displace said setup socket.

* * * * *